US009089741B2

(12) United States Patent
Kaluza et al.

(10) Patent No.: US 9,089,741 B2
(45) Date of Patent: Jul. 28, 2015

(54) GOLF BALL GRABBER

(76) Inventors: Bernhard Kaluza, Racine, WI (US); Ralph Rhein, Racine, WI (US)

( * ) Notice: Subject to any disclaimer, the term of this patent is extended or adjusted under 35 U.S.C. 154(b) by 361 days.

(21) Appl. No.: 13/370,893

(22) Filed: Feb. 10, 2012

(65) Prior Publication Data

US 2012/0208652 A1 Aug. 16, 2012

Related U.S. Application Data

(60) Provisional application No. 61/442,324, filed on Feb. 14, 2011.

(51) Int. Cl.
*A63B 47/02* (2006.01)

(52) U.S. Cl.
CPC ..... *A63B 47/02* (2013.01)

(58) Field of Classification Search
USPC ..... 473/286; 294/19.2
See application file for complete search history.

(56) References Cited

U.S. PATENT DOCUMENTS

| | | | | | |
|---|---|---|---|---|---|
| 802,264 | A | * | 10/1905 | Brown | 294/19.2 |
| 1,658,145 | A | * | 2/1928 | Uyei | 294/19.2 |
| 3,318,628 | A | * | 5/1967 | White | 294/19.2 |
| 3,698,720 | A | * | 10/1972 | Gudmundsen | 473/286 |
| 4,862,970 | A | * | 9/1989 | Hlavacek | 172/378 |
| 4,991,896 | A | | 2/1991 | Martin | |
| 5,152,565 | A | | 10/1992 | Dodd | |
| 5,165,744 | A | | 11/1992 | Vogrin | |
| 5,188,409 | A | | 2/1993 | Forey | |
| 5,368,302 | A | | 11/1994 | Thomas | |
| 5,383,659 | A | | 1/1995 | Taylor | |
| 5,395,146 | A | | 3/1995 | Liu et al. | |
| 5,437,488 | A | | 8/1995 | Richmond et al. | |
| 5,759,117 | A | | 6/1998 | Erickson, Jr. | |
| 5,924,175 | A | * | 7/1999 | Lippitt et al. | 24/537 |
| 6,171,202 | B1 | * | 1/2001 | Schmitt | 473/286 |
| 6,190,265 | B1 | * | 2/2001 | Schmitt | 473/286 |
| 6,199,926 | B1 | * | 3/2001 | Lemoine | 294/19.2 |
| 6,254,497 | B1 | | 7/2001 | Brant et al. | |
| 6,348,017 | B1 | | 2/2002 | Yates | |
| D477,644 | S | * | 7/2003 | Schmitt | D21/721 |
| 6,692,372 | B1 | | 2/2004 | Colucci | |
| 6,743,113 | B2 | * | 6/2004 | Pettinga et al. | 473/286 |
| 6,899,635 | B2 | | 5/2005 | Nadratowski et al. | |
| D524,886 | S | * | 7/2006 | Baril | D21/721 |
| 7,165,796 | B1 | | 1/2007 | Hung | |
| 7,229,365 | B2 | | 6/2007 | Berry | |
| 7,309,293 | B2 | | 12/2007 | Dunks | |

(Continued)

*Primary Examiner* — Stephen L. Blau
(74) *Attorney, Agent, or Firm* — Jansson Munger McKinley & Shape Ltd.

(57) ABSTRACT

A golf ball-grabbing device including a cap affixable at the longitudinal extremity of the grip of a putter shaft and having a single central opening therethrough with finger-receiving guide notches therearound, and a movable grabber assembly having (a) a base member shaped to be movably retained within the shaft below the cap and (b) at least three non-destructibly resiliently-deformable resiliently-deformable strip-like fingers each having a proximal end secured to the base member, an arcuate ball-grabbing portion, and a distal end terminating in a camming member having a substantially-planar ball-engagable face, each finger slidably engaged within one of the notches. The movable grabber assembly is slidable with respect to the cap between a non-use position in which the arcuate portions of the fingers are contained only by the shaft and a use position in which the arcuate portions of the fingers are deployed outside the shaft and above the cap.

20 Claims, 6 Drawing Sheets

(56) References Cited

U.S. PATENT DOCUMENTS

| | | | | |
|---|---|---|---|---|
| 7,351,156 | B1 * | 4/2008 | Panneri et al. | 473/132 |
| 7,351,158 | B1 * | 4/2008 | Bronsveld | 473/286 |
| 7,384,347 | B2 | 6/2008 | Milne | |
| 7,645,200 | B2 * | 1/2010 | Downey | 473/286 |
| 7,713,136 | B1 * | 5/2010 | Colucci | 473/286 |
| D682,330 | S * | 5/2013 | Reay | D15/147 |
| 8,469,969 | B2 * | 6/2013 | Kear et al. | 606/127 |
| 2002/0155897 | A1 * | 10/2002 | Schmitt | 473/286 |
| 2003/0195054 | A1 * | 10/2003 | Rioux | 473/286 |
| 2003/0236129 | A1 | 12/2003 | Pettinga et al. | |
| 2007/0010345 | A1 | 1/2007 | Milne | |
| 2007/0191131 | A1 | 8/2007 | Nickel | |
| 2009/0149270 | A1 * | 6/2009 | Nickel | 473/286 |

* cited by examiner

GOLF BALL GRABBER

RELATED APPLICATION

This application is based on Provisional Application Ser. No. 61/442,324, filed on Feb. 14, 2011.

FIELD OF THE INVENTION

This invention relates generally to the field of devices for use in the sport of golf and more particularly to the field of devices for picking up golf balls.

BACKGROUND OF THE INVENTION

In the game of golf, players are frequently required to bend down to pick up balls from places below or at ground level. The ball is regularly picked up from the bottom of the golf hole, a cup-shaped depression which is at least 4 inches below the surface of the putting green. (See USGA Rules of Golf, Definitions Section; http://www.usga.org/Rule-Books/Rules-of-Golf/Definitions/#Rules). Golf is enjoyed by players greatly varied in physical ability, so that a significant number of golfers experience difficulty performing the essential physical task of picking up the ball.

This difficulty has long been known and accordingly has been addressed in prior art. The prior art includes numerous devices which are not incorporated into a golf club or any other piece of golf equipment necessarily carried by players. All such prior art requires the user to carry an additional piece of equipment, which is generally substantial in size and weight and is therefore burdensome. Such prior art includes U.S. Pat. No. 4,991,896 (Martin), U.S. Pat. No. 5,152,565 (Dodd), U.S. Pat. No. 5,165,744 (Vogrin), U.S. Pat. No. 5,188,409 (Forey), U.S. Pat. No. 5,383,659 (Taylor), U.S. Pat. No. 5,395,146 (Liu et al), U.S. Pat. No. 5,437,488 (Richmond et al), U.S. Pat. No. 5,759,117 (Erickson), U.S. Pat. No. 6,254,497 (Brandt et al), U.S. Pat. No. 6,348,017 (Yates), U.S. Pat. No. 7,165,796 (Hung) and U.S. Pat. No. 7,229,365 (Berry). No such prior art resembles the present invention in basic form or functional detail.

The prior art also includes golf putter heads incorporating means for picking up golf balls. Such prior art includes U.S. Pat. No. 5,368,302 (Thomas) and U.S. Pat. No. 6,692,372 (Colucci) and Patent Application Publication No. U.S. 2007/0191131 (Nickel). All such prior art presents substantial disadvantages relating to putter-head shape and size in that the requirement of shape and size allowing incorporation of pick-up means is unrelated to the putter head's essential purpose of striking the ball and sharply limiting with respect to essential performance-related considerations. Many popular putter-head shapes and sizes are too small or incompatibly-shaped for incorporation of pick-up means. Golfers typically hold preferences for certain putter-head shapes and sizes based on subtle, nuanced and highly-individual performance factors relevant to ball striking, such as feel and distribution of weight. Golfers typically find unwieldy and unhelpful any putter-head shape or size that serves a purpose, such as ball pick-up, other than the essential purpose of striking the ball effectively.

Some prior art includes pick-up means incorporated or installed not into the putter head but rather into or onto the grip-end of the putter. Some such prior art, U.S. Pat. No. 6,889,635 (Nadratowski) and U.S. Pat. No. 7,309,293 (Dunks), teaches a cup or other cavity lacking dynamic grabbing means helpful to ball pick-up. Other such prior art teaches dynamic grabbing means. This prior art includes U.S. Pat. No. 3,318,628 (White), U.S. Pat. No. 6,743,113 (Petting a et al) and U.S. Pat. No. 7,384,347 (Milne), as well as Patent Application Publication No. U.S. 2009/0149270 (Nickel) and a wire-finger pickup device made by Nickel.

Although the incorporation of dynamic grabbing means is generally an improvement, all such prior art lacks satisfactory functionality, durability, ease of installation and simplicity of manufacture. Some of the key problems of the prior art devices related to durability; for example, devices using wire fingers for the grabbing means are prone to bend, deform and break beyond usefulness, making the useable life of the products unacceptably short. Others are unacceptably rigid and thus difficult to use. Despite the great need for acceptable ball-grabbing devices, particularly for senior and handicapped golfers, there has been no widely-accepted device which is easy to use, highly durable, simple to manufacture and easy to install.

OBJECTS OF THE INVENTION

It is the object of this invention to provide an improved device for picking up golf balls which incorporates dynamic grabbing means and overcomes the problems and shortcomings of the prior art described above.

More particularly, it is an object of the invention to provide a ball-grabbing device with dynamic grabbing means, the shape, construction and materials requirements of which combine for superior functionality, including without limitation the following: easy and reliable spreading and closing of the grabbing means when the device is in its use position; easy, reliable and secure ball engagement and holding of the ball by the grabbing means; easy and reliable removability of the ball from the grabbing means; and easy and reliable adjustment between the device's non-use position and use position (and vice versa), allowing for the user to actuate such adjustment by an extremely simple motion of the hand.

Still another object of the invention is to provide a ball-grabbing device with dynamic grabbing means, the shape, construction and materials requirements of which combine for qualities of superior durability including without limitation the following: sufficient elasticity to return reliably, precisely and automatically to original shape even after severe deformative manipulation; sufficient rigidity to easily and reliably spread and close; sufficient rigidity to easily, reliably and securely engage and hold a golf ball; sufficient rigidity to reliably maintain shape for purposes of easy and reliable adjustment between the device's non-use position and use position (and vice versa); minimal number and variation of parts, thus further minimizes potential for breakage or malfunction.

A further object of the invention is to provide a ball-grabbing device which may be made primarily of a single material, having extremely simple construction with minimal number and variation of parts, thus providing advantages of simple and inexpensive manufacture and assembly.

Yet another object of the invention is to provide such a ball-grabbing device having advantages of easy installation-capability universally into any standard putter.

How these and other objects are accomplished will become apparent from the following descriptions and the drawings.

SUMMARY OF THE INVENTION

The invention is an improvement in a ball-grabbing device for securement with respect to a tubular golf-putter shaft. The ball-grabbing device of this invention is of the type including fingers for grabbing the golf ball.

The improved ball-grabbing device of this invention includes (1) a cap affixable at the longitudinal extremity of the grip end of the putter shaft, such cap having a single central opening therethrough with finger-receiving guide notches spaced therearound; and (2) a movable grabber assembly having (a) a base member shaped to be movably retained within the shaft below the cap and (b) at least three non-destructibly resiliently-deformable strip-like fingers each having a proximal end secured to the base member, an arcuate ball-grabbing portion, and a distal end terminating in a camming member having a substantially-planar ball-engagable face, each finger slidably engaged within one of the guide notches. The movable grabber assembly is slidable with respect to the cap between a non-use position in which the arcuate portions of the fingers are below the cap and contained only by the shaft and a use position in which the arcuate portions of the fingers are outside the shaft and above the cap.

In certain preferred embodiments of the invention, each strip-like finger has a proximal portion that extends along the length of the base member within the shaft in both the use and non-use positions, and the base member has proximal and distal ends, the proximal end of each finger being attached to the proximal end of the base member and being pivotable about the point of securement. In certain of such embodiments, the base member has finger-receiving grooves therealong aligned with the guide notches and dimensioned to freely receive the proximal portions of the strip-like fingers, thereby facilitating finger spreading and closing movements.

In certain preferred embodiments of the invention, when the movable grabber assembly is in the use position, each of the strip-like fingers, from its point of emergence from the central opening, first extends radially outwardly to a middle portion and then radially inwardly to the camming member, the camming member being radially outwardly turned such that its face is radially inwardly facing. This facilitates finger-spreading upon engagement of a ball therewith.

In highly-preferred embodiments, there are three strip-like fingers which are spaced equidistantly relative to each other at 120° circumferential intervals. Three fingers are particularly useful but devices with more fingers are also within the scope of the invention. Each strip-like finger along both its arcuate and proximal portions is preferably dimensioned such that its circumferential width dimension is greater than its radial thickness dimension. This facilitates resilient deformation for ball-gripping and movement between use and non-use positions.

The circumferential width dimension of the strip-like fingers is preferably about twice their radial thickness dimension, and the circumferential width dimension of the strip like fingers is about 3 mm.

In certain highly-preferred embodiments, the inside surface of each finger at the juncture of its included arcuate portion and camming member includes an inwardly-facing nub dimensioned for engagement with a golf ball dimple. This facilitates reliable ball engagement and holding.

The ball-engagable face of each camming member is preferably scallop-shaped, and the thickness of the camming member is preferably approximately the same as the radial thickness of the strip-like finger which it terminates.

In certain preferred embodiments, the cap includes connector openings between adjacent pairs of notches, and connector screws extend through the connector openings for securement to the putter handle.

The ball-grabbing device of the invention preferably comes in the form of a kit which includes a drill-engagable cylindrical cutting tube with a toothed circular cutting edge, the cutting edge having a diameter sufficient to cut a hole in the hand grip which hole is dimensioned to receive the base member therethrough while leaving hand grip material at the grip end of the putter for securement of the cap thereover by connector screws. The cylindrical cutting tube preferably includes a guide pin which is centrally located with respect to the circular cutting edge and extends beyond the cutting edge to facilitate accurate engagement with the hand grip for purposes of cutting the hole therein.

While one form of the invention is a ball-grabbing device as described above, the invention also involves a combination of a tubular golf-putting shaft with such ball-grabbing device secured thereon.

The movable grabber assembly, which includes at least three non-destructibly resiliently-deformable strip-like fingers, is preferably formed of a polymeric material dimensioned to provide the essential non-destructibly resiliently-deformable qualities of the strip-like fingers. One highly-preferred material is DELRIN® 100, a high-viscosity acetal homopolymer available from DuPont. Other suitable mold-injectable polymeric materials include highly-crystalline engineering thermoplastics with high mechanical and flexural strength and impact resistance such as suitable polyacetals, polyimides, polycarbonates, ABS, nylons, polythenylenes, polyterephthaletes and polysulfones, and acceptable copolymers thereof, selected for their required non-destructible resilient-deformability.

The invention is based in part on the fact that the strip-like fingers of the movable grabber assembly can be greatly distorted in various directions and will nonetheless recover their original orientation and retain their important resilient ball-grabbing qualities. The term "non-destructibly resiliently-deformable" as used herein is an adjective describing this advantageous aspect of the strip-like fingers. Because the strip-like fingers are non-destructibly resiliently-deformable, they withstand both long repetitive use as well as acute physical distress such as is sometimes exerted upon installed devices of this kind when a golf club is forcefully impacted during play or in transport. Concerns of damage or breakage by bending during deployment for use, during use and during retraction after use are thus eliminated. The shape of the strip-like fingers and their related material and functional qualities combine to provide these and other essential advantages.

The invention provides numerous essential advantages relating to ball engagement. Without limitation, these include the following.

The substantially-planar ball-engagable faces of the camming members of the device of this invention simultaneously engage the substantially-spherical ball surface. Each camming member's substantially-planar face engages the ball surface with an amount of force opposed equally by the combined forces simultaneously being exerted on the ball surface by the differently-angled faces of all other camming members (usually two). Because all camming members have substantially-planar faces, their inwardly-directed collectively-opposing forces against the ball surface are directed relative to each other at precise optimal angles against the ball surface, facilitating reliable sliding of the faces across the ball surface and reliable radial spreading of the fingers around the ball.

Reliability of spreading is further facilitated by the requirements of preferred embodiments that the camming member faces be radially inwardly facing and that the fingers be three in number and spaced equidistantly relative to each other at 120° circumferential intervals. The strip-like shape of the fingers, including in preferred embodiments the requirement that each finger's circumferential width dimension be greater than its radial thickness dimension, further provides optimal direction of forces against the ball and related reliability of radial spreading of the fingers around the ball; while readily spreading radially, fingers so shaped resist twisting and lateral movement relative to the ball such as would make ball-engagement more difficult and less reliable.

Scallop-like shaping of the camming member faces, as required in preferred embodiments, further provides reliability of ball engagement by greatly increasing the ability of each camming member to exert force against multiple points on the substantially-spherical but partially-planar (e.g., across dimples) ball surface, thus facilitating reliability and security of engagement, and eliminating the possibility of lateral finger movement relative to the ball surface such as would create risk of ball-disengagement. The inwardly-facing nub of preferred embodiments facilitates reliable and secure engagement by providing for finger engagement with golf ball dimples, particularly in the latter stage of engagement immediately before the ball is held.

All such advantages are further facilitated and maximized by the resiliently-deformable quality of the fingers. Such advantages are further facilitated and maximized by the guide notches of the cap and by, in preferred embodiments, the finger-receiving grooves of the base member, which guide all radial and pivotal movement of the fingers such that they reliably and increasingly engage the ball to the point where the arcuate portions of the fingers close upon the ball and it is held.

The invention also provides numerous important advantages relating to ball holding. Without limitation, these include the following.

The arcuate portions and strip-like shape of the fingers facilitate reliable and secure holding of the ball by providing reliable and regularly-distributed finger contact with the ball surface along at least three longitudinal lines of some substantial width. The inwardly-facing nub of preferred embodiments further facilitates reliable and secure holding, as each nub engages with a dimple of the held ball, thus providing non-slidability of each finger relative to the ball surface.

The resiliently-deformable quality of the fingers together with the specific guidance and limitations of movement provided by the guide notches, by the finger-receiving grooves and by the fingers' securement to the base member, as well as by equidistant spacing of the fingers relative to each other in preferred embodiments, combine to provide even and unvarying distribution of grabbing force on and around the ball, further facilitating reliability and security of ball holding.

The invention further provides essential advantages relating to release of a golf ball (subsequent to pick-up). Without limitation, these include the following.

The resiliently-deformable quality of the fingers, together with qualities of shape facilitating radial spreading of the fingers, provides for easy manual extraction of a ball from the fingers in any direction not blocked by the longitudinal extremity of the grip end of the putter.

Essential advantages relating to adjustment from the use position to the non-use position are also noted. Without limitation, these include the following.

The resiliently-deformable quality of the fingers, together with the slidability of the movable grabber assembly with respect to the cap and the specific guidance and limitations of movement provided by the guide notches, by the finger-receiving grooves and by the fingers' securement to the base member, provides for easy and reliable adjustability from the use to the non-use position. The resiliently-deformable quality of the fingers together with the tension provided by the interaction of the arcuate portions of the fingers and the guide notches provides for smoothness and accuracy in such adjustment.

The interaction of the guide notches with the camming members' substantially-planar ball-engagable faces, including in preferred embodiments in which the faces are scallop-shaped and radially inwardly facing with the camming member being radially outwardly turned, provides certainty, regularity and security of movable-grabber-assembly position upon completion of adjustment from the use position to the non-use position.

Additionally, the scallop-shaped faces of preferred embodiments provide substantial surface area along the outer edges of the camming members, facilitating easy and comfortable engagement with the palm of the user's hand for purposes of manual adjustment of the device from the use position to the non-use position.

Essential advantages relating to adjustment from the non-use position to the use position are additionally noted. Without limitation, these include the following.

The resiliently-deformable quality of the fingers together with the tension provided by the interaction of the arcuate portions of the fingers and the guide notches provides for smoothness and accuracy in such adjustment. The shape of the camming members' ball-engagable faces, including in preferred embodiments in which the faces are scallop-shaped and radially inwardly facing with the camming member being radially outwardly turned, provides a convenient fingertip-gripping point for the user for purposes of easy and reliable manual adjustment from the non-use position to the use position.

Additionally, the retainment of the base member within the shaft below the cap eliminates any risk that the movable grabber assembly could fall off or out of the putter grip during or after adjustment from the non-use position and eliminates any need for any additional part for purposes of retaining the device, or any part thereof, on or within the putter grip.

Certain essential advantages also facilitate simple and inexpensive manufacture and assembly. These include without limitation the simplicity of shape and construction and, the minimal number and variation of parts (e.g., with respect to shape and materials). As noted above, retainment of the base member within the shaft below the cap provides eliminates any risk that the movable grabber assembly could fall off or out of the putter grip during or after adjustment from the non-use position and eliminates any need for any additional part for purposes of retaining the device, or any part thereof, on or within the putter grip.

Further essential advantages facilitate easy installation-capability universally into any standard putter. These include a basic simplicity of shape and pre-installation interconnectedness of parts such that any user can install the device onto and into the grip end of any standard putter, using the cylindrical cutting tube and screws. Such installation is made easier still in preferred embodiments by the requirement of the guide pin in the cutting tube, which facilitates accurate cutting and installation on and through the longitudinal extremity of the grip end of the putter.

DETAILED DESCRIPTION OF PREFERRED EMBODIMENTS

Figure 1B:
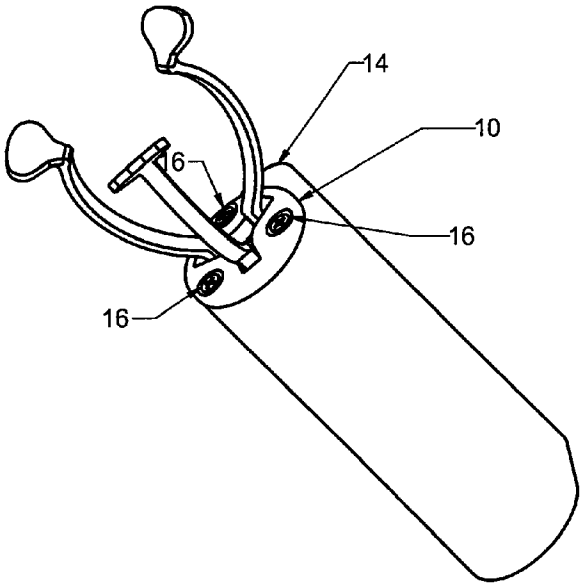
FIG. 1B is an enlarged perspective installed and assembled view of the device of FIG. 1A.

The figures illustrate a ball-grabbing device 10 which is a highly-preferred embodiment of this invention. Most of the parts of device 10 are shown in several of the drawings, although identified by numbers only in some of the drawings for convenience.

Ball-grabbing device 10 has two principal portions, including a cap 18 and a movable grabber assembly 28. Cap 18 is a disc-like member having a single central opening 20 with three finger-receiving guide notches 22, 24 and 26 spaced at 120° circumferential intervals about the center of cap 18. Grabber assembly 28 consists of four plastic parts, including a base member 30 shaped to be removably retained within the golf club shaft below cap 18, and three strip-like fingers 32, 34 and 36. Strip-like fingers 32, 34 and 36 each have a proximal end 38 secured to base member 30, an arcuate ball-grabbing portion 40 and a distal end 42 that terminates in a camming member 44. Camming member 44 has a planar ball-engagable face 46. Faces 46 cooperate in camming acting over golf ball 2 which causes the spreading of finger 32, 34 and 36 and the sliding movement of such fingers, each within its respective guide notch 22, 24 or 26 within cap 18.

Figure 4:
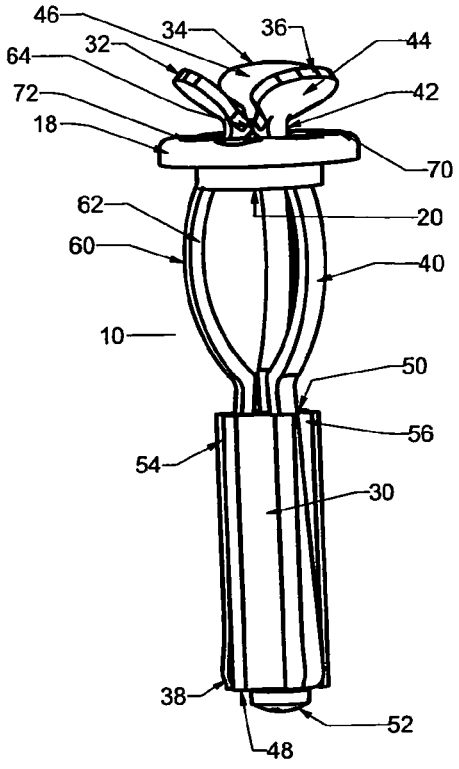
FIG. 4 is a side-perspective view of the device in the non-use position.
Figure 3:
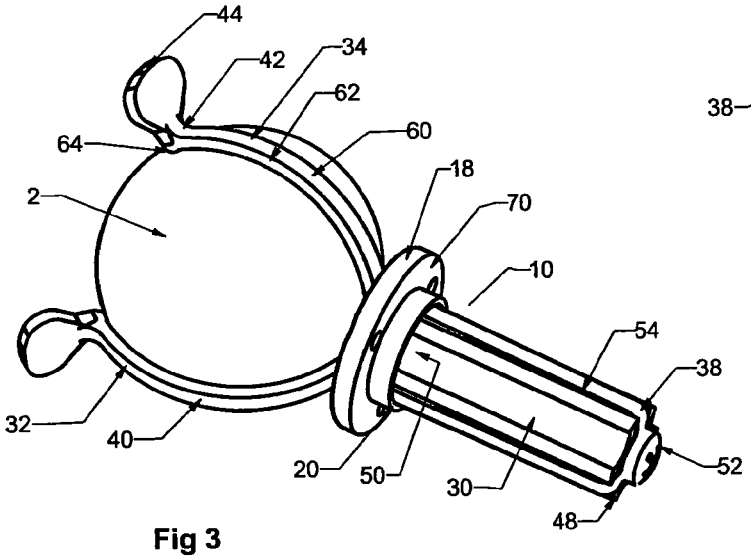
FIG. 3 is a perspective view as in FIGS. 2A and 2B but with the uninstalled device holding a golf ball.

Movable grabber assembly 28 is slidable with respect to cap 18 between a non-use position, as seen in FIG. 4, and a deployed use position, as seen in FIGS. 1A, 1B, 2A, 2B and 3. In the non-use position, arcuate portions 40 of the fingers are below cap 18 and contained only by the putter shaft 12; in the use position, arcuate portions 40 of the fingers are outside shaft 12 and above cap 18.

Figure 5B:
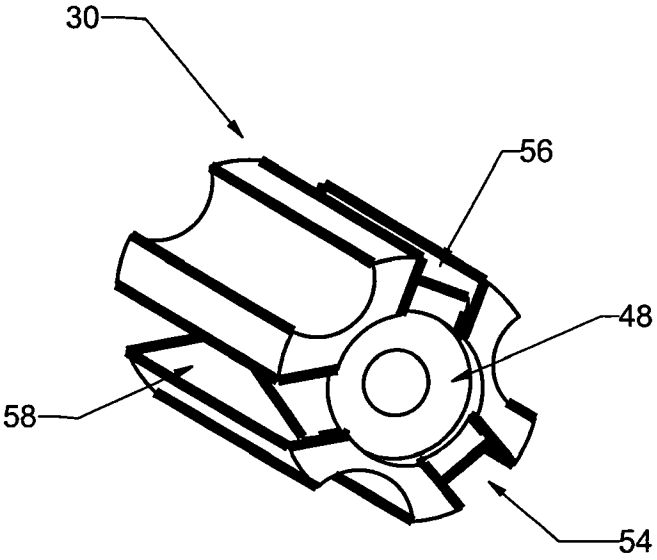
FIG. 5B is a perspective view of the base member similar to FIG. 5A, but facing the proximal end of such base member.
Figure 5A:
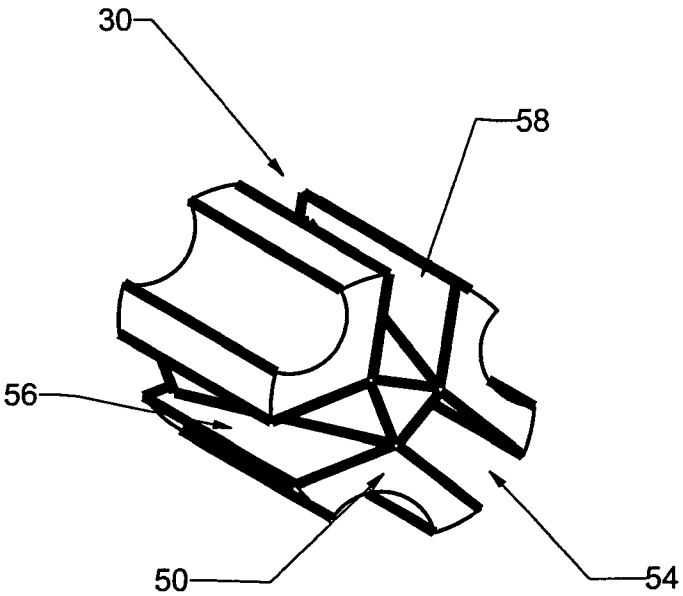
FIG. 5A is a perspective view of the base member of the device facing the distal end of such base member.

Each of strip-like fingers 32, 34 and 36 has a proximal portion extending from proximal end 38 of the finger along the length of base member 30 within shaft 12, in both the use and non-use positions. Base member 30 has a proximal end 48 and a distal end 50, and proximal 38 of each finger is attached to base member proximal end 48 by a screw at point of securement 52. Each of fingers 32, 34 and 36 pivots with respect to base member 30 about point of securement 52. This pivoting action facilitates the spreading and closing movements of fingers 32, 34 and 36. As shown best in FIGS. 5A and 5B, base member 30 has three finger-receiving grooves 54, 56 and 58 therealong, each aligned with a respective one of guide notches 22, 24 and 26 in cap 18. Finger-receiving grooves 54, 56 and 58 are dimensioned to freely receive the proximal portions of the finger which extend along base member 30.

This configuration and arrangement of grooves, notches, finger portions and long (i.e., along the full length of fingers 32, 34 and 36) pivoting action is an important feature of this invention, particularly when it comes to the excellent finger action and durability of device 10.

When movable grabber assembly 28 is in the use position, each of the fingers from its point of emergence from central opening 20 first extends radially outwardly to a middle portion and then radially inwardly to camming member 44. Each camming member 44 is turned radially outwardly such that its face 46 is generally radially inwardly facing. As noted above, this facilitates finger spreading upon ball engagement.

The cross-sectional configuration of each of fingers 32, 34 and 36 is an important aspect of preferred embodiments of this invention. Each finger has a circumferential width dimension 60 which is about twice its radial thickness dimension 62. More specifically, the circumferential width dimension of this preferred embodiments is about 3 mm. It has been found that using highly-preferred materials such as Delrin® 100 and the dimensioning described gives highly-beneficial performance.

Each camming member 44 is scallop-shaped and has a thickness which is about the same as the radial thickness of the strip-like finger which it terminates.

Figure 2B:
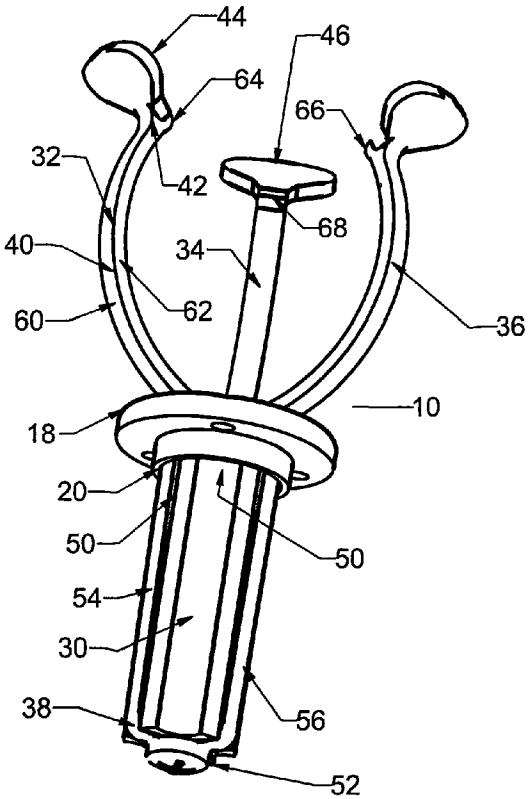
FIG. 2B is a perspective view similar to that of FIG. 2A, but viewed from below the cap of the uninstalled device.
Figure 2A:
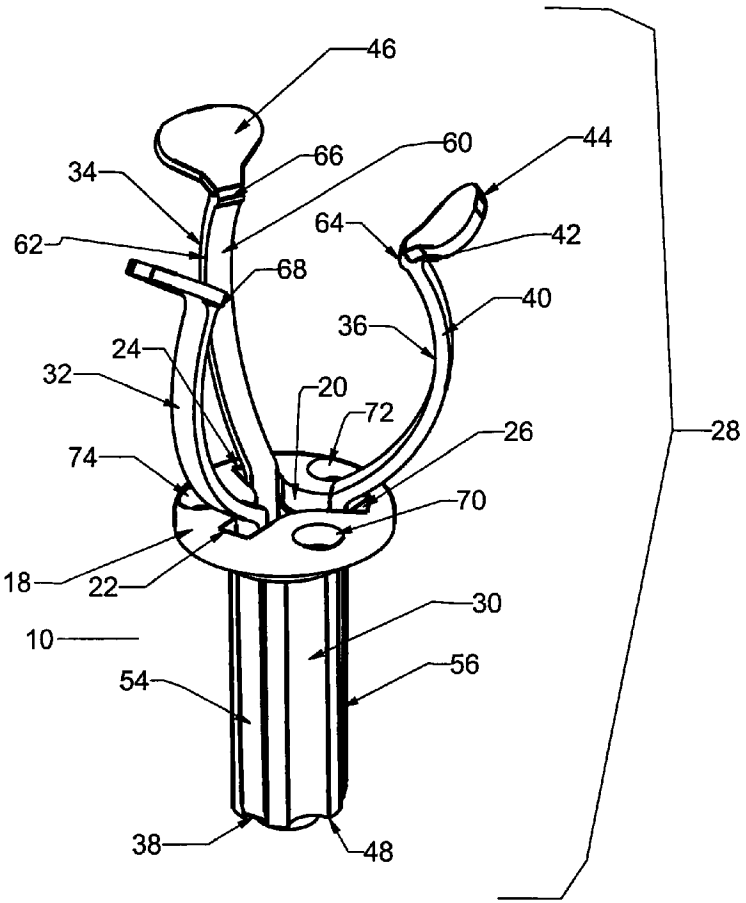
FIG. 2A is a further enlarged perspective view of the device in its use position, uninstalled, as viewed from above the cap of the device.

As shown best in FIGS. 2A and 2B, the inside surface of each finger at the juncture of its arcuate portion and camming member includes an inwardly-facing nub 64, 66 or 68. Such nubs are configured to facilitate reliable ball engagement and holding, taking advantage of standard golf ball dimples.

Figure 1A:
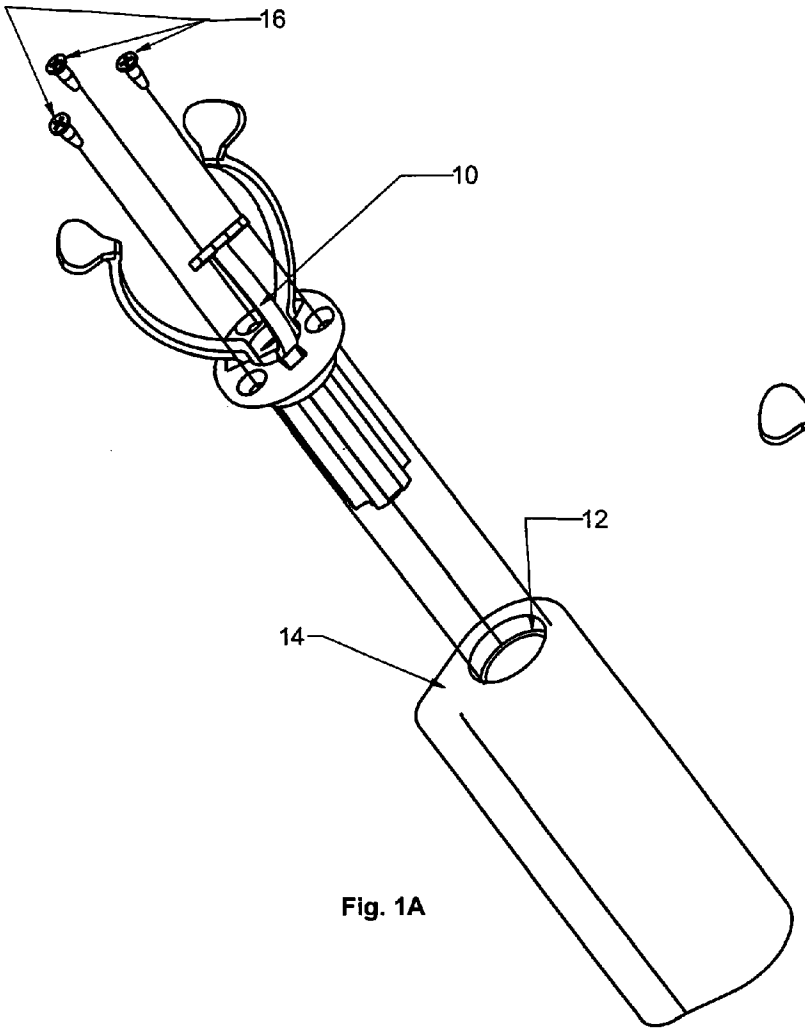
FIG. 1A is a partially-exploded perspective view of the invention with putter grip end, prior to installation.
Figure 6:
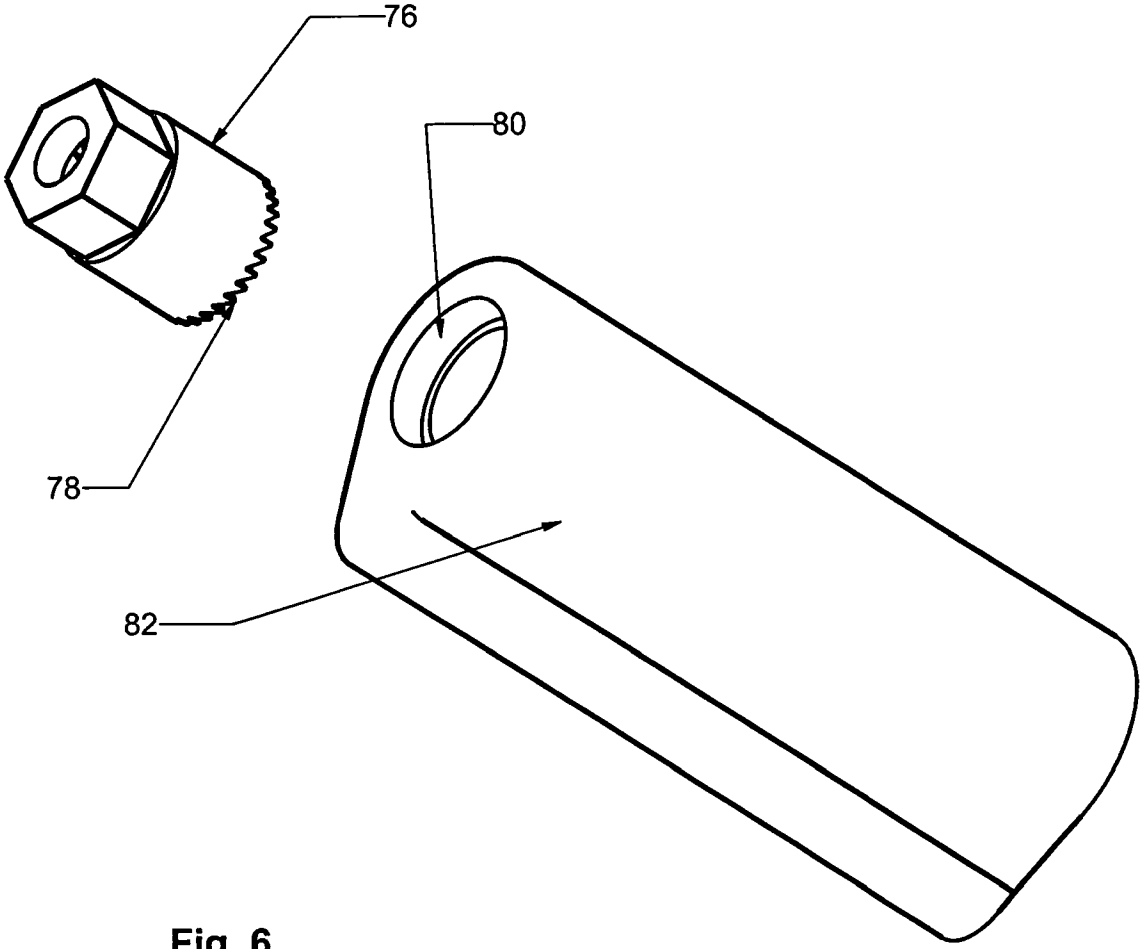
FIG. 6 is a fragmentary perspective view of a putter grip showing the longitudinal extremity thereof together with the cylindrical cutting tube used for installation purposes.

As shown best in FIG. 2A, cap 18 also includes three connector openings 70, 72 and 74 and, as shown best in FIGS. 1A and 1B, screws 16 extend through such openings for securement to the hand grip material at the grip end of the putter 82. Such attachment can be made once when ball grabbing device 10 is installed in putter handle grip 82, after a properly located hole 80 is cut in the longitudinal extremity of the grip end of the putter 14. Cutting such hole 80 is facilitated by cylindrical cutting tube 76, as illustrated best in FIGS. 6, 7A and 7B.

Figure 7B:
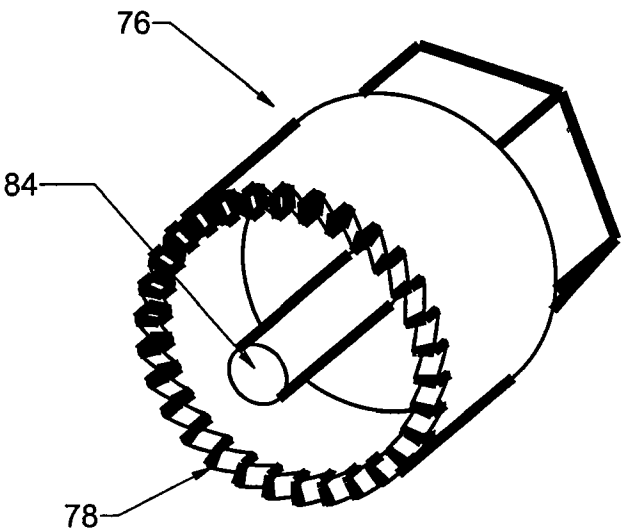
FIG. 7B is a similar enlarged perspective view of the cylindrical cutting tube, but facing the cutting end thereof.
Figure 7A:
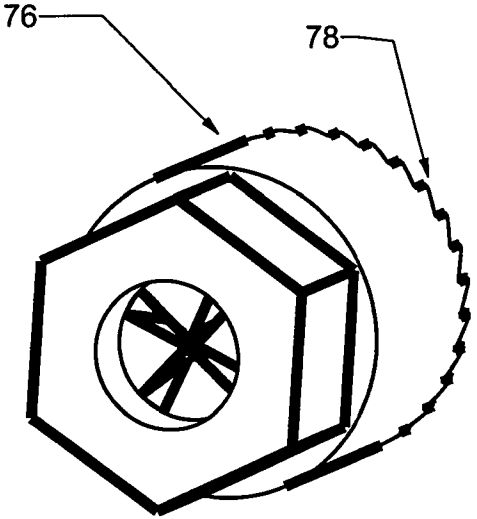
FIG. 7A is a greatly enlarged perspective view of the cylindrical cutting tube shown in FIG. 6, facing the drill-engagable end thereof.

Cutting tube 76 is part of the kit which includes ball grabbing device 10 of this invention. Cutting tube 76 has a drill-engagable end which is seen best in FIGS. 6 and 7A and a cutting edge 78 which is seen best in FIGS. 6 and 7B. FIG. 7B also shows guide pin 84 which is used to assist in properly centering cutting tube 76 for purposes of cutting and installation.

The illustrated embodiment of this invention provides all of the advantages of the invention. As indicated above, a variety of acceptable materials meeting the requirements of this invention are available and would be apparent to those skilled in the art who have become familiar with the invention.

While the principles of the invention have been shown and described in connection with a specific embodiment, it is to be understood that such embodiment is by way of example and is not limiting.

The invention claimed is:

1. In a ball-grabbing device for securement with respect to a tubular golf-putter shaft, the device including fingers for grabbing the ball, the improvement comprising:

a cap affixable at the longitudinal extremity of a grip end of the putter shaft, such cap having a single central opening therethrough with finger-receiving guide notches spaced therearound; and a movable grabber assembly having (a) a base member shaped to be movably retained within the shaft below the cap and (b) at least three non-destructibly resiliently-deformable strip-like forgers each having a proximal end secured to the base member, an arcuate ball-grabbing portion, and a distal end terminating in a camming member having a substantially-planar ball-engagable face, each finger slidably engaged within one of the guide notches, the movable grabber assembly being slidable with respect to the cap between a non-use position in which the arcuate portions of the fingers are below the cap and contained only by the shaft and a use position in which the arcuate portions of the fingers are outside the shaft and above the cap.

2. The ball-grabbing device of claim 1 wherein:

each strip-like finger has a proximal portion that extends along the length of the base member within the shaft in both the use and non-use positions; and the base member has proximal and distal ends, the proximal end of each finger being attached to the proximal end of the base member and being pivotable about the point of securement.

3. The ball-grabbing device of claim 2 wherein the base member has finger-receiving grooves therealong aligned with the guide notches and dimensioned to freely receive the proximal portions of the strip-like fingers, thereby facilitating finger spreading and closing movements.

4. The ball-grabbing device of claim 1 wherein, when the movable grabber assembly is in the use position, each of the strip-like fingers, from its point of emergence from the central opening, first extends radially outwardly to a middle portion and then radially inwardly to the camming member, the camming member being radially outwardly turned such that its face is radially inwardly facing, thereby facilitating finger-spreading upon engagement of a ball therewith.

5. The ball-grabbing device of claim 1 wherein the strip-like fingers are three in number and spaced equidistantly relative to each other at 120° circumferential intervals.

6. The ball-grabbing device of claim 5 wherein each strip-like finger along both its arcuate and proximal portions is dimensioned such that its circumferential width dimension is greater than its radial thickness dimension, thereby facilitating resilient deformation for ball-gripping and movement between use and non-use positions.

7. The ball-grabbing device of claim 6 wherein the circumferential width dimension of the strip-like fingers is about twice the radial thickness dimension.

8. The ball-grabbing device of claim 7 wherein the circumferential width dimension of the strip-like fingers is about 3 mm.

9. The ball-grabbing device of claim 1 wherein the inside surface of each finger at the juncture of its included arcuate portion and camming member includes an inwardly-facing nub dimensioned for engagement with a golf ball dimple, thereby to facilitate reliable ball engagement and holding.

10. The ball-grabbing device of claim 1 wherein the ball-engagable face of each camming member is scallop-shaped and the thickness of the camming member is approximately the same as the radial thickness of the strip-like finger which it terminates.

11. The ball-grabbing device of claim 1 wherein the cap includes connector openings between adjacent pairs of notches, and connector screws extend through the connector openings for securement to the putter handle.

12. The ball-grabbing device of claim 1 wherein the strip-like fingers of the movable grabber assembly are of an engineering plastic material selected to provide non-destructible resilient-deformability.

13. The ball-grabbing device of claim 12 wherein the movable grabber assembly is a unitary piece of such material.

14. The ball-grabbing device of claim 1 wherein the movable grabber assembly is a unitary piece of Delrin® 100.

15. In a combination tubular golf putter shaft and ball-grabbing device secured thereon, the device including fingers for grabbing the ball, the improvement comprising:

a cap affixed at the longitudinal extremity of a grip end of the putter shaft, such cap having a single central opening therethrough with finger-receiving guide notches spaced therearound; and a movable grabber assembly having (a) a base member movably retained within the shaft below the cap and (b) at least three non-destructibly resiliently-deformable strip-like fingers each having a proximal end secured to the base member, an arcuate ball-grabbing portion, and a distal end terminating in a camming member having a substantially-planar ball-engagable face, each finger slidably engaged within one of the guide notches, the movable grabber assembly being slidable with respect to the cap between a non-use position in which the arcuate portions of the fingers are below the cap and contained only by the shaft and a use position in which the arcuate portions of the fingers are outside the shaft and above the cap.

16. The ball-grabbing device of claim 15 wherein:

each strip-like finger has a proximal portion that extends along the length of the base member within the shaft in both the use and non-use positions; and the base member has proximal and distal ends, the proximal end of each finger being attached to the proximal end of the base member and being pivotable about the point of securement.

17. The ball-grabbing device of claim 16 wherein the base member has finger-receiving grooves therealong aligned with the guide notches and dimensioned to freely receive the proximal portions of the strip-like fingers, thereby facilitating finger spreading and closing movements.

18. The ball-grabbing device of claim 15 wherein, when the movable grabber assembly is in the use position, each of the strip-like fingers, from its point of emergence from the central opening, first extends radially outwardly to a middle portion and then radially inwardly to the camming member, the camming member being radially outwardly turned such that its face is radially inwardly facing, thereby facilitating finger-spreading upon engagement of a ball therewith.

19. The ball-grabbing device of claim 15 wherein each strip-like finger along both its arcuate and proximal portions is dimensioned such that its circumferential width dimension is greater than its radial thickness dimension, thereby facilitating resilient deformation for ball-gripping and movement between use and non-use positions.

20. The ball-grabbing device of claim 15 wherein the inside surface of each finger at the juncture of its included arcuate portion and camming member includes an inwardly-facing nub dimensioned for engagement with a golf ball dimple, thereby to facilitate reliable ball engagement and holding.

* * * * *

UNITED STATES PATENT AND TRADEMARK OFFICE

CERTIFICATE OF CORRECTION

PATENT NO. : 9,089,741 B2
APPLICATION NO. : 13/370893
DATED : July 28, 2015
INVENTOR(S) : Kaluza et al.

It is certified that error appears in the above-identified patent and that said Letters Patent is hereby corrected as shown below:

In the claims

At column 9, line 4, Claim 1, delete “forgers” and insert --fingers--.

Signed and Sealed this
Twenty-second Day of December, 2015

Michelle K. Lee

Michelle K. Lee
*Director of the United States Patent and Trademark Office*